US005405311A

United States Patent [19]

Pecora et al.

[11] Patent Number: 5,405,311

[45] Date of Patent: Apr. 11, 1995

[54] PRESSURE POINT APPARATUS TO HELP ALLEVIATE TENSE MUSCLES

[76] Inventors: Damiano C. Pecora, 80 English Street, Brampton, Ontario, Canada, L6X 2P6; Cosma G. Pecora, 41 Millrun Crescent, Woodbridge, Ontario, Canada, L4H 1A4

[21] Appl. No.: 28,292

[22] Filed: Mar. 9, 1993

[51] Int. Cl.[6] ..... A61H 7/00

[52] U.S. Cl. ..... 601/135; 601/133; 606/204; 606/204.15

[58] Field of Search ..... 128/59-62 R; 606/237, 238, 201, 204, 204.15

[56] References Cited

U.S. PATENT DOCUMENTS

| | | | |
|---|---|---|---|
| 723,735 | 3/1903 | Schillberg | 128/59 |
| 859,507 | 7/1907 | Murdoch | 128/62 R |
| 1,424,884 | 8/1922 | Deane | 606/237 |
| 1,710,822 | 4/1929 | Hassler | 128/59 |
| 1,726,560 | 9/1929 | Hassler | 128/67 |
| 1,933,989 | 11/1933 | McCollugh | 601/136 |
| 2,249,145 | 7/1941 | Kraft | 128/59 |
| 2,468,327 | 4/1949 | Hartung | 606/237 |
| 2,959,167 | 11/1960 | Leclabart | 128/59 |
| 3,107,665 | 10/1963 | Nordgren | 128/62 R |
| 3,373,739 | 3/1968 | Rankin | 128/59 |
| 3,837,336 | 9/1974 | Taubert | 128/59 |
| 4,471,768 | 9/1984 | Ciullo | 606/86 |
| 4,493,315 | 1/1985 | Iwahashi | 128/60 |
| 4,944,747 | 7/1990 | Newth et al. | 606/204 |
| 5,094,227 | 3/1992 | Eglauf et al. | 601/135 |

FOREIGN PATENT DOCUMENTS

| | | | |
|---|---|---|---|
| 422105 | 2/1936 | United Kingdom | 128/59 |
| 1648407 | 5/1991 | U.S.S.R. | 606/201 |
| 8100202 | 2/1981 | WIPO | 606/204 |

*Primary Examiner*—Robert A. Hafer
*Assistant Examiner*—Brian E. Hanlon
*Attorney, Agent, or Firm*—Gifford, Krass, Groh, Sprinkle, Patmore, Anderson & Citkowski

[57] ABSTRACT

A therapy tool for applying pressure to muscles of the human body comprising two elongate, rigid bar members each having first and second ends. The first ends are for hand gripping and the second ends are pivotally connected to one another. Each bar member includes three or more protrusions which project transversely from one side of the bar member and which are spaced from one another and from the second end of the respective bar member. Each protrusion applies pressure to the human body at a single area. Preferably there are at least three of the protrusions on each bar member.

13 Claims, 3 Drawing Sheets

PRESSURE POINT APPARATUS TO HELP ALLEVIATE TENSE MUSCLES

BACKGROUND OF THE INVENTION

This invention relates to therapy tools for applying pressure to muscles of the human body for the purpose of relieving pain or tension.

Studies have shown that by applying point pressure on sore muscles, one can activate tension release that can help alleviate tension headaches, neck pain, back aches and other muscle related pains. In order to accomplish tension release, light pressure might be required in sensitive areas of the body while stronger pressure may be required and can be tolerated in many areas of the body that are not as sensitive. Professional chiropractors have applied pressure in this manner to sore muscles for years and have achieved considerable success with this technique. When done properly, this method of tension release can cause the patient to experience a natural soothing feeling of relaxation.

The term "trigger points" is used sometimes to designate pain points in the body that many medical therapies try to relieve or deactivate. One such well known therapy is known as myotherapy and the techniques of this therapy call for pressure to be exerted on these points in the body to deactivate or detrigger these particular points, followed by performance of specific exercises. The technique can result in the relief of pain or stress without the use of drugs. The pressure can be exerted to detrigger the trigger points by a therapist using a part of his or her body, ie. fingers, knuckles and elbows. Of course, such therapy necessitates that a second person be able to act as the therapist and this is a significant drawback.

There is a need to improve the manner in which pain or stress therapy such as myotherapy can be performed when one needs to do it to oneself. In particular, there is a need for a simple, inexpensive tool that can be used by an individual to detrigger his own or her own trigger points.

Recent U.S. Pat. No. 4,944,747 issued Jul. 31, 1990 to Gregory Newth et al describes a hand operated tool for deactivating trigger points in the body, which tool comprises a slightly curved, elongate handle with a flattened section. The flattened section includes a single round protrusion and an eye hook at the tip. A flexible strap is connected to the eye hook and is used to manipulate the tool while applying pressure to a trigger point. This known tool suffers from several drawbacks, including the fact that it can be difficult to use for the purpose of applying pressure to certain specific areas of the body, partly due to the flexibility of the strap. It is also limited to applying pressure by means of a single protrusion only and does not easily permit, for example, the application or pressure to two opposing areas of the body or a limb at the same time. Furthermore, the tool may not be particularly suitable for applying pressure to certain areas of the body such as to an arm or leg.

SUMMARY OF THE INVENTION

According to one aspect of the invention, a therapy tool for applying pressure to muscles of the human body comprises two elongate, rigid bar members each having first and second ends. The first ends are adapted for hand gripping and the second ends are pivotally connected to one another by a pin member. Each bar member includes two or more rigid protrusions which project transversely from one side of the bar member and which are spaced from one another along the length of the bar member and are spaced from the first ends of the respective bar member. Each protrusion is adapted to apply pressure to the human body at a single area of the body.

Preferably there are at least three of the protrusions on each bar member. In a particular preferred embodiment, the protrusions are generally cylindrical with a diameter of less than one inch.

According to another aspect of the invention, a therapy tool for applying pressure to muscles of the human body comprises two elongate, rigid bar members each of which is adapted for hand gripping at one end and is pivotally connected to the other bar member at the opposite end by means of a pin member. At least one of the bar members has at least three rigid protrusions which project transversely from one side of the bar member and which are spaced from one another along the length of the bar member and are spaced from the opposite end of the bar member. Each protrusion is adapted to apply pressure at a single area of the body.

Further features and advantages will become apparent from the following detailed description taken in conjunction with the accompanying drawings.

DETAILED DESCRIPTION OF PREFERRED EMBODIMENT

Figure 1:
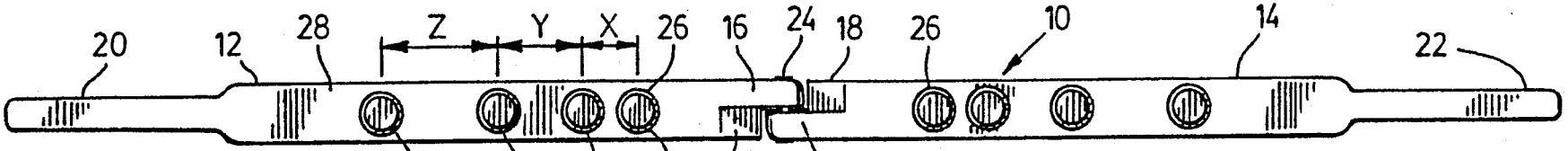
FIG. 1 is a top view of a therapy tool constructed in accordance with the invention with the two bar members laid out flat.

A therapy tool 10 for applying pressure to muscles of the human body includes two elongate, rigid bar members 12 and 14 each having first ends 20 and 22 and second ends 16 and 18. The first ends are adapted for hand gripping and are formed to provide a handle. The second ends are pivotally connected to one another by means of a single pin member 24. In order that the two bar members can be detached readily from one another for transport or storage, the pin member 24 may comprise an internally threaded sleeve member formed with a head at one end and a screw that can be screwed into the sleeve member after the latter has been inserted through openings formed in the end 16, 18.

Each bar member 12, 14 includes two or more protrusions 26 which project transversely from one side 28 of the bar member and which are spaced from one another and from the second end 16 or 18 of the respective bar member. These protrusions are adapted to apply pressure to the human body at a single area of the body. Preferably there are at least three protrusions on each bar member in order to make the tools suitable for applying pressure to a variety of body muscles including neck muscles, arm muscles, leg muscles and back muscles.

Figure 2:
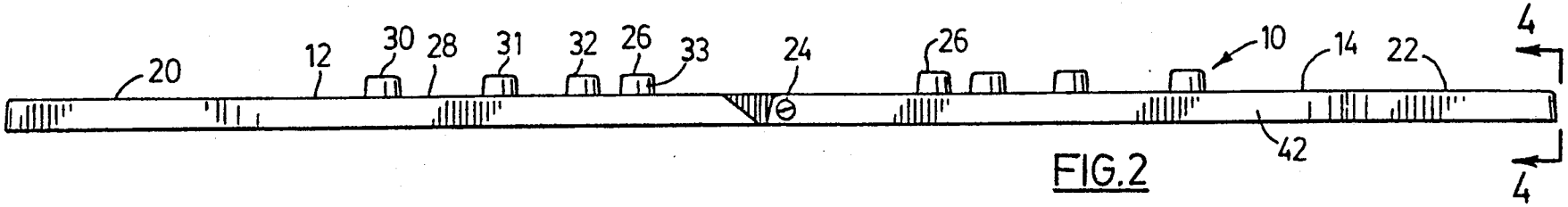
FIG. 2 is a side view of the therapy tool of FIG. 1, again with the tool laid out flat.

In the particularly preferred embodiment illustrated in the drawings, there are four protrusions indicated at 30 to 33 in FIGS. 1 and 2. The preferred protrusions are rigid and generally cylindrical with a diameter of less than one inch. In one particular preferred embodiment, the diameter of each protrusion was approximately $\frac{7}{8}$ths inch and the height of each protrusion was about $\frac{5}{8}$ths inch. In this particular preferred embodiment, the distance from the connecting pin to the closest protrusion 33 was approximately 4 inches. The space X separating protrusions 32 and 33 was about 1 $\frac{1}{2}$ inches while the space Y separating protrusions 31 and 32 was a greater distance being approximately 2 inches. The space Z separating protrusions 30 and 31 in the preferred embodiment was approximately 3 inches. To describe the placement of the protrusions in another way, in this preferred embodiment the second protrusion 32 was at least 5 inches from the point of connection of the bar members and a third protrusion 31 was at least 7 inches from this point of connection. In this embodiment, the total length of each rigid bar member was approximately 20 inches. Although the use of shorter bar members is certainly possible, it is preferred that each bar member 12, 14 be at least 18 inches long in order to permit this therapy tool to be used at a wide variety of locations on the body and to permit adequate pressure to be applied to those muscles that can tolerate strong pressure.

It will be understood that the preferred spacing of the protrusions is chosen so as to accommodate a variety of muscles in the user's body. The inner protrusions that are closer together are effectively applied to smaller and narrower parts of the body such as the neck, arm, and foot. The outer protrusions which are farther apart are used on larger or wider areas of the body such as the back, shoulders, and thigh muscles. The inventors have found by empirical methods that these different spacings of the protrusions are appropriate to accommodate a variety of body sizes and different muscular areas in a manner which will permit the user to use the tool by himself conveniently and easily.

Figure 5:
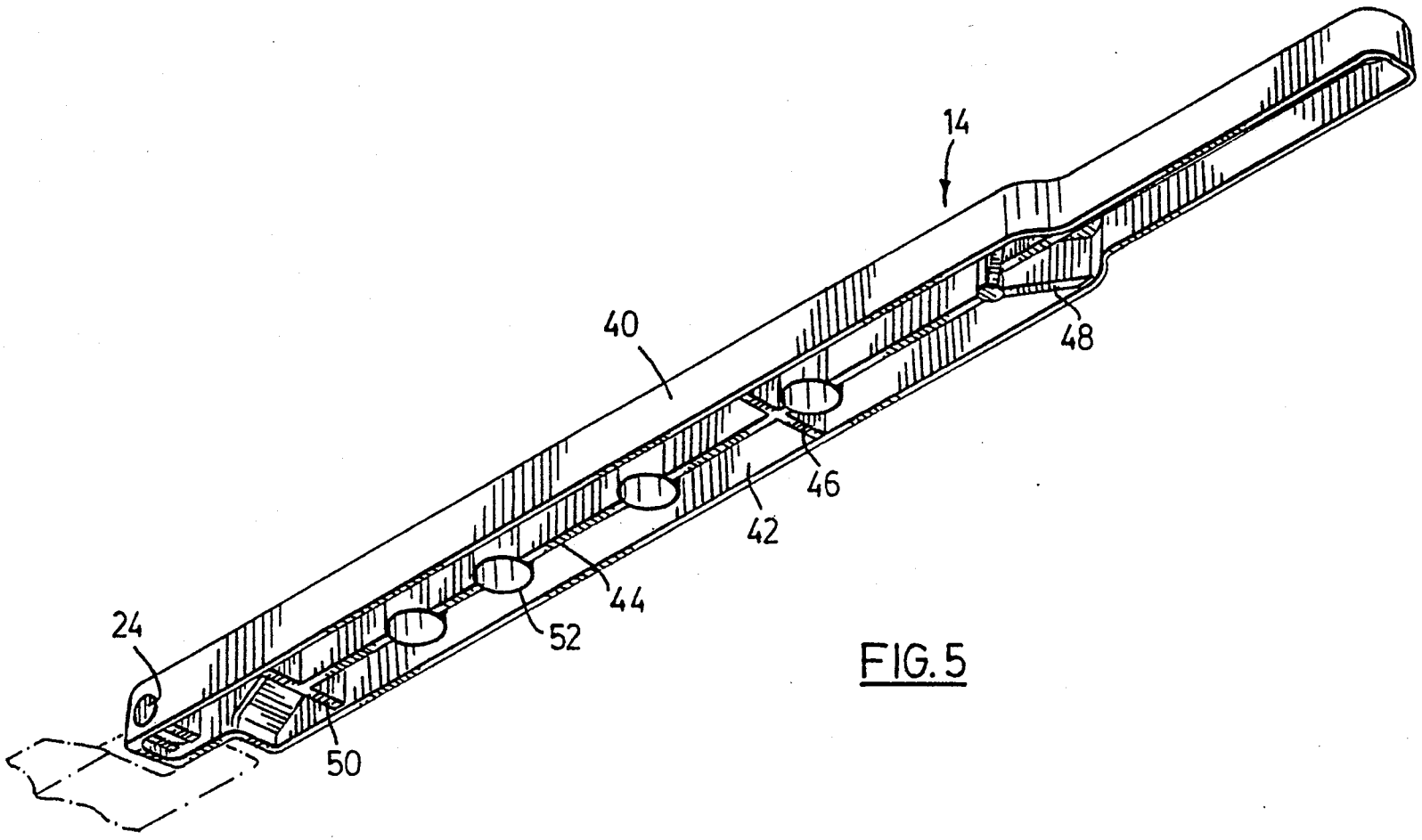
FIG. 5 is a perspective view showing the underside of one of the bar members used for the tool of the invention.

The bar members 12 and 14 can be constructed from a variety of rigid materials including strong plastics material, metals such as steel and iron, and wood. However, the preferred material of construction is a strong plastics material such as acrylonitrile butadiene styrene (ABS). The use of plastics material permits the therapy tool to be relatively light and constructed in the manner illustrated in FIG. 3. As can be seen from FIG. 3 and from FIG. 5, each bar member 12, 14 is formed with side flanges 40 and 42 that extend about the periphery of the bar member and that provide the bar member with the required strength. There can also be an internal web 44 which can extend most of the length of the bar member. Short connecting webs 46 and 48 extending between the flanges can also be provided to provide increased lateral and torsional strength. The central web 44 extends to transversely extending connecting Web 50 and it also extends between hollow base portions 52 of the protrusions 26. In order to save plastics material, the protrusions 26 are hollow and open at the bottom as shown in FIG. 3.

Figure 3:
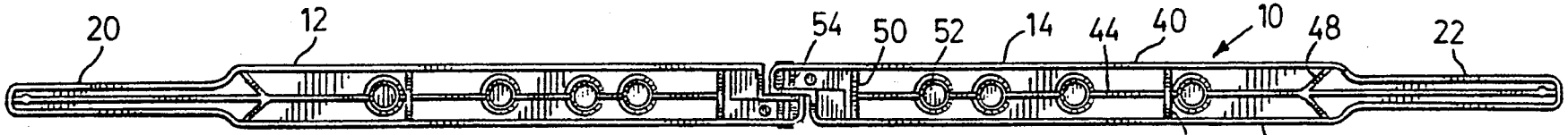
FIG. 3 is a bottom view of the therapy tool of FIG. 1.
Figure 4:
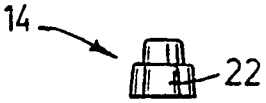
FIG. 4 is an end view of the handle end of one of the rigid bar members.

It will be particularly noted from FIGS. 1 to 3 that the two bar members 12 and 14 are preferably identical to one another with the same number of protrusions on each. It will be appreciated that this can result in a considerable cost saving when each bar member is made from plastics material, the reason being that only a single mould is required to produce the two bar members 12 and 14. As shown in the drawings, the protrusions on the bars are formed integrally with the bar members.

In order to permit the two bar members to be longitudinally aligned and to permit the use of a relatively short pin member 24, each bar member 12, 14 is reduced in width at its end 16, 18. Thus, each bar member has an end section 54 having a width one half the portion of the bar member on which the protrusions are formed. Immediately adjacent each end section 54 is a sloping end surface 56 which permits the bar members to be swung together to form a relatively sharp V-shape as shown, for example, in FIG. 6.

Figure 6:
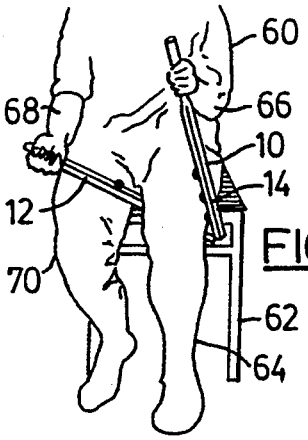
FIG. 6 is a schematic illustration showing use of the present therapy tool to apply pressure to leg muscles.
Figure 7:
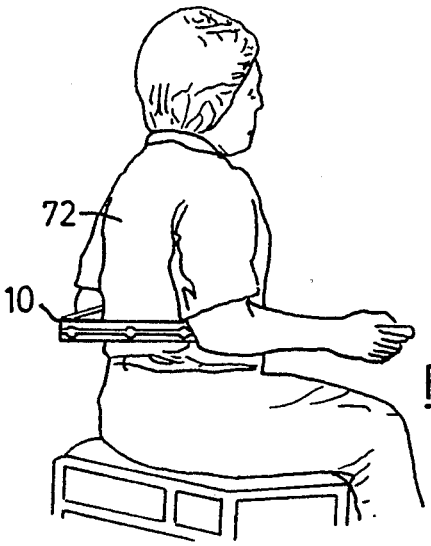
FIG. 7 is another schematic illustration showing use of the present tool to apply pressure to back muscles.
Figure 8:
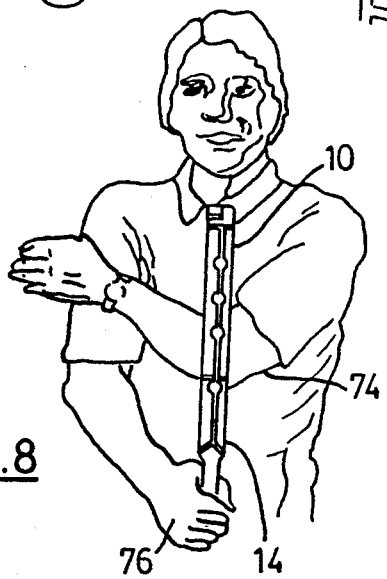
FIG. 8 is a schematic view showing use of the present tool to apply pressure to arm muscles.

FIGS. 6 to 8 illustrate some of the ways in which the therapy tool of the present invention can be used. In FIG. 6 the tool 10 is held with both hands, one on the handle portion of each bar member. With the person 60 sitting on a chair 62, he or she can use the tool to apply pressure to specific areas of one leg 64. In the illustration, the person's thigh is placed between the two bar members 12, 14 to apply pressure to certain stress points of major muscles in the thigh. The tool is adjusted to use the most convenient protrusion or knob for application to the selected stress point. The user applies gradual pressure with the tool using one arm 66. In this particular use of the tool, the bar member 12 can be stabilized or braced using both the other arm 68 and the other leg 70. It should be noted that the tool 10 is not used to rub the area of stress or pain. In other words, it is not a massaging tool or device. Pressure can be applied to the selected spot from 5 to 10 seconds at a time and it is repeated as needed. The present tool should not be used to apply pressure to bony surfaces or to injured areas.

FIG. 7 illustrates how the present tool can be used to apply pressure to muscles in the lower back area of the body. In this case, the tool 10 is grasped with both hands so that the waist area is placed between the bar members 12 and 14. The connecting point of the bar members is located a distance to the rear of the user's back 72. Then by pushing inwardly on the bar members with one's hands and forearms, one can apply the required pressure to stress points that are located in the lower back region. Note that with the present tool it is possible to apply equal amounts of pressure to stress points on opposite sides of the lower back.

FIG. 8 illustrates how the present tool 10 can be used to apply pressure to muscles in the region of a user's elbow 74. As illustrated, one bar member 14 has its handle gripped with the user's right hand 76. The other bar member 12 (not shown in FIG. 8) is placed between the elbow and the stomach or chest of the user and thus can be braced against the body as the bar member 14 is pulled inwardly to apply pressure.

Figure 9:
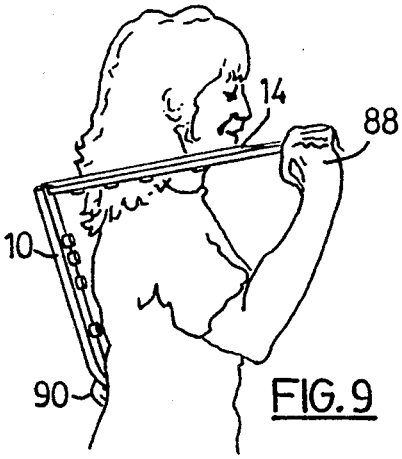
FIG. 9 is a schematic illustration showing use of the tool to apply pressure to a shoulder muscle.
Figure 10:
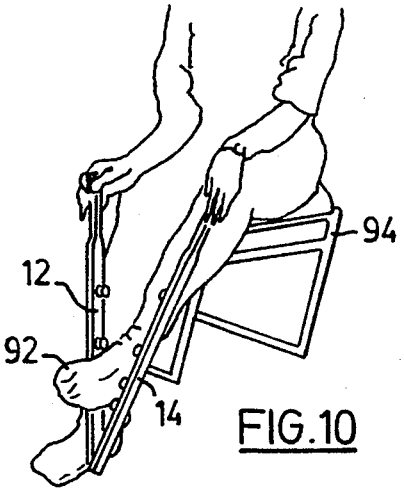
FIG. 10 is a schematic illustration showing use of the tool to apply pressure to foot muscles.
Figure 11:
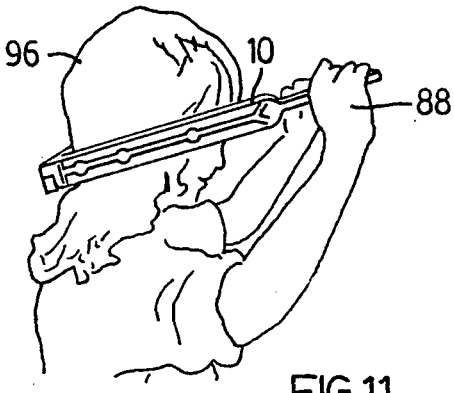
FIG. 11 is a schematic illustration showing use of the tool to apply pressure to the neck region.

The present tool can also be used to apply pressure to the back of a user's neck and to stress points in a foot, and to stress points in the shoulder region as shown in FIGS. 9 to 11.

In FIG. 9 the present tool 10 is used to apply pressure to muscles in the shoulder region. As illustrated, one bar member 14 has its handle gripped with the user's left hand 88 with the left elbow bent. The user's right hand is located near the rear of the user's waist at 90 where it holds the handle of the other bar member. Pressure can be applied to the shoulder region by the user pulling forwardly with his left hand 88.

In FIG. 10 the protrusions that are closest to the connecting point of the bar members are used to apply pressure to stress points in a foot 92. The foot is inserted between the two bar members 12 and 14 while the user is seated on chair 94. Pressure is applied by pushing the handles of the two bar members towards one another.

FIG. 11 illustrates how the present tool 10 can be used to apply pressure to the back of a user's neck. The base of the head 96 is placed between the two bar members so that the connecting point of these members is to the rear of the neck. Each handle is gripped in the respective hand of the user and the handles are pushed or pulled inwardly towards one another to apply pressure.

Although the drawings illustrate a preferred version of the applicant's therapy tool, it will be appreciated by those skilled in the art that various modifications and changes can be made to this tool without departing from the spirit and scope of this invention. For example, although the handle portions of the bar members are shown with a generally rectangular cross-section, the handles could be made with a cylindrical shape or could be semi-cylindrical. Also, the protrusions may vary in size and shape from the preferred illustrated protrusions and their locations can vary along the length of each bar member, The present therapy tool can also be equipped with optional devices or attachments to vibrate or heat the tool and the protrusions formed thereon. These can be electrically operated and of standard construction, An electrical cord could run from the end of one handle to provide power or the devices could be battery powered, Although the use of a simple hinge mechanism is illustrated in the drawings and described above, other forms of hinges and joints can be used, for example, a swivel hinge. Also, though the use of rigid protrusions made of plastic has been described, the protrusions could also be made with some flexibility and resiliency, if desired. More flexible and softer protrusions may be desirable for the release of stress in sensitive areas of the body. It will be appreciated by those skilled in the art that all possible modifications and changes as fall within the scope of the appended claims are intended to form part of this invention.

We therefore claim:

1. A therapy tool for applying pressure to a set of localized points on muscles of the human body, said tool comprising two elongate, rigid bar members each having first and second ends, said first ends being adapted for hand gripping and said second ends being pivotally connected to one another by a pin member, each bar member including a plurality of rigid protrusions which project transversely from one side of the bar member and which are spaced from one another along the length of the bar member, said plurality of protrusions including at least a first protrusion spaced from said second end of the respective bar member, a second protrusion immediately following said first protrusion and spaced from said first protrusion by a first distance, and a third protrusion immediately following said second protrusion and spaced from said second protrusion by a second distance said second distance is greater than said first distance such that spacing between adjacent protrusions gradually increases from said second end to said first end of said respective bar member, each protrusion being adapted to apply pressure to the human body at a single area of the body.

2. A therapy tool according to claim 1 wherein said protrusion are formed integrally on said bar members.

3. A therapy tool according to claim 2 wherein said protrusions are generally cylindrical with a diameter of less than one inch.

4. A therapy tool according to claim 2 wherein said two bar members are identical to one another with the same number of protrusions on each.

5. A therapy tool according to claim 2 wherein said first protrusion is about 4 inches from the point of connection of the bar members, said second protrusion is at least 5 inches from said point of connection and said third protrusion is at least 7 inches from said point of connection.

6. A therapy tool according to claim 1 wherein there is a fourth protrusions on each bar member.

7. A therapy tool according to claim 6 wherein the distances separating the four protrusions on each bar member are between 1.5 inches and $\beta$ inches.

8. A therapy tool according to claim 1 wherein each bar member is made of strong plastics material.

9. A therapy tool according to claim 1 wherein each bar member is at least 18 inches long.

10. A therapy tool for applying pressure to muscles of the human body, said tool comprising two elongate, rigid bar members each of which is adapted for hand gripping at one end and is pivotally connected to the other bar member at the opposite end thereof by means of a single pin, each of said bar members having at least first, second and third rigid protrusions which project transversely from one side of each respective bar member and which are spaced from one another along the length of the bar member, said first protrusion adjacent said opposite end and said second protrusion immediately following said first protrusion and spaced from said first protrusion by a first distance and said third protrusion immediately following said second protrusion and spaced from said second protrusion by a second distance, said second distance is greater than said first distance such that spacing between adjacent protrusions gradually increases from said opposite end to said one end of each respective member, each protrusion being adapted to apply pressure at a single area of the body.

11. A therapy tool according to claim 10 wherein said protrusions are generally cylindrical with a diameter of less than 1 inch.

12. A therapy tool according to claim 10 wherein each bar member has a fourth protrusion and each of said four protrusions is formed integrally on each respective bar member.

13. A therapy tool according to claim 10 wherein each bar member is made of strong plastics material.

* * * * *

UNITED STATES PATENT AND TRADEMARK OFFICE

CERTIFICATE OF CORRECTION

PATENT NO. : 5,405,311

DATED : April 11, 1995

INVENTOR(S) : Pecora et al.

It is certified that error appears in the above-indentified patent and that said Letters Patent is hereby corrected as shown below:

Column 4, line 1: Replace "Web" with --web--.

Column 5, line 33: Replace "member," with --member.--.

Column 5, line 40: Replace "powered," with --powered.--.

Column 6, line 12: Replace "protrusion" with --protrusions--.

Column 6, line 29: Replace "B" with --3--.

Signed and Sealed this

Sixteenth Day of January, 1996

Bruce Lehman

*Attest:*

BRUCE LEHMAN

*Attesting Officer*

*Commissioner of Patents and Trademarks*